US008641143B2

(12) United States Patent
Deck

(10) Patent No.: US 8,641,143 B2
(45) Date of Patent: Feb. 4, 2014

(54) THERAPUTIC SUPPORT DEVICE

(76) Inventor: Brent Douglas Deck, Kansas City, KS (US)

( * ) Notice: Subject to any disclaimer, the term of this patent is extended or adjusted under 35 U.S.C. 154(b) by 210 days.

(21) Appl. No.: 12/287,809

(22) Filed: Oct. 14, 2008

(65) Prior Publication Data

US 2009/0134674 A1 May 28, 2009

Related U.S. Application Data

(60) Provisional application No. 60/998,759, filed on Oct. 13, 2007.

(51) Int. Cl.
*A47C 15/00* (2006.01)

(52) U.S. Cl.
USPC . 297/243; 297/257; 297/195.11; 297/195.12; 297/195.13

(58) Field of Classification Search
USPC ..... 297/243, 244, 245, 257, 195.11, 297/195.12, 195.13; 128/845
See application file for complete search history.

(56) References Cited

U.S. PATENT DOCUMENTS

| | | | | | |
|---|---|---|---|---|---|
| 1,352,409 | A | * | 9/1920 | Hoefener | 297/241 |
| 2,446,376 | A | * | 8/1948 | Littlejohn | 297/241 |
| 2,860,688 | A | * | 11/1958 | Edge | 297/423.14 |
| 3,554,191 | A | * | 1/1971 | Barnes | 602/39 |
| 4,542,936 | A | * | 9/1985 | Gafken | 297/257 |
| 4,618,140 | A | * | 10/1986 | Brown | 482/73 |
| 4,640,548 | A | * | 2/1987 | Desanta | 297/300.3 |
| 4,699,423 | A | * | 10/1987 | Fitzig et al. | 297/245 |
| 4,921,303 | A | * | 5/1990 | White | 297/338 |
| 5,072,929 | A | * | 12/1991 | Peterson et al. | 482/72 |
| 5,385,154 | A | * | 1/1995 | Fuhrman et al. | 128/845 |
| 5,875,779 | A | * | 3/1999 | Fuhrman et al. | 128/845 |
| 5,957,529 | A | * | 9/1999 | Schrewe | 297/232 |
| 6,065,808 | A | * | 5/2000 | Tinsley | 297/423.11 |

* cited by examiner

*Primary Examiner* — Sarah B McPartlin

(57) ABSTRACT

The present invention relates to therapeutic furniture and apparatus and therapeutic method wherein a recumbent or semi-recumbent therapist applies foot or hand pressure therapy to the patient seated in tandem configuration in front of therapist, and wherein both patient and therapist are supported by device.

30 Claims, 6 Drawing Sheets

FIG. 11A
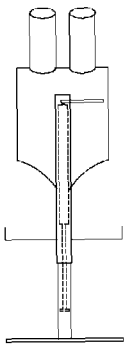
FIG. 1A
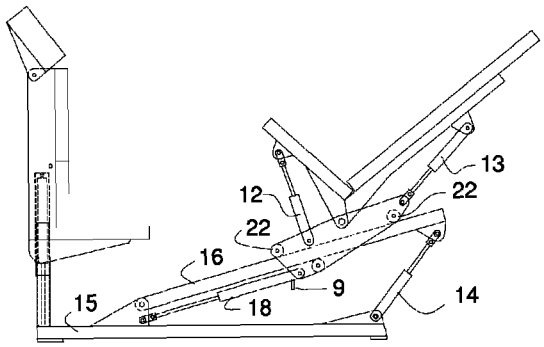
FIG. 11B
FIG. 1B
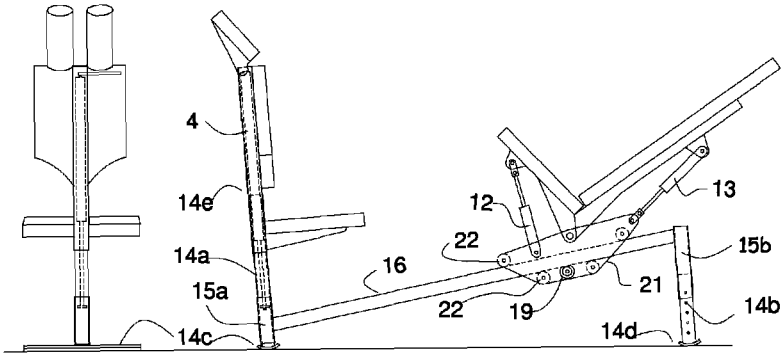
FIG. 11C
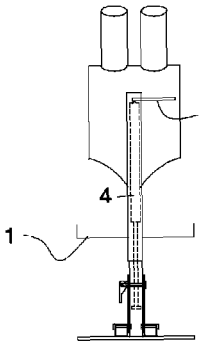
FIG. 1C
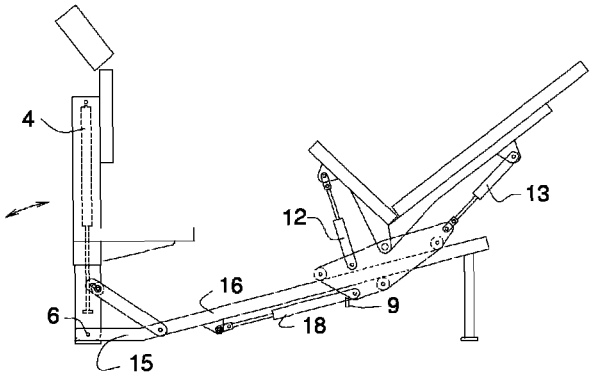

FIG. 7A
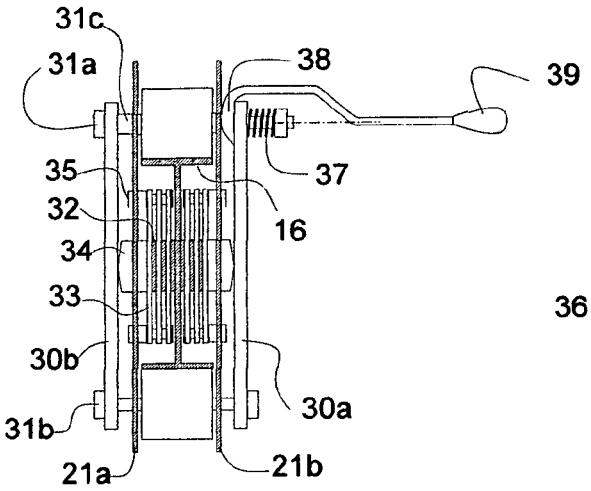
FIG. 7B
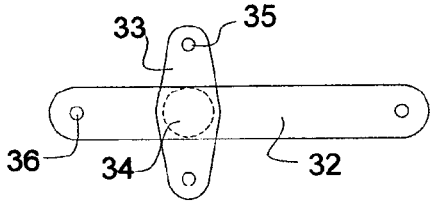
FIG. 7E
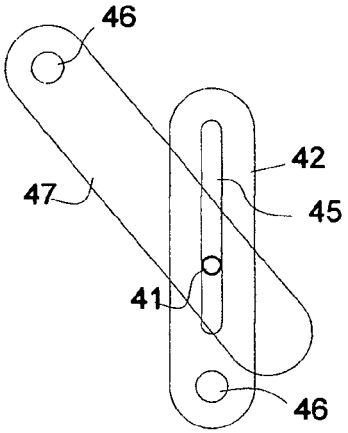
FIG. 7D
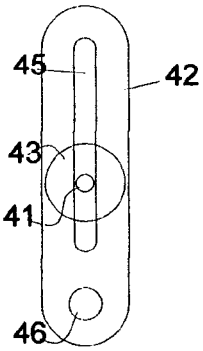
FIG. 7C
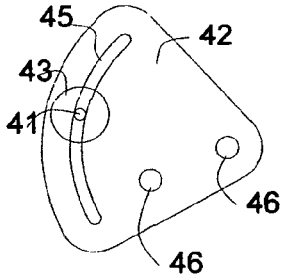
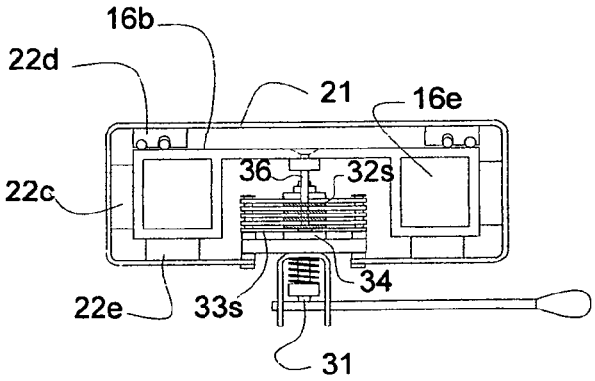
FIG. 7F

THERAPUTIC SUPPORT DEVICE

This application claims priority of provisional application 60998759 filed Oct. 13, 2007.

FIELD OF INVENTION

The present invention relates to therapeutic furniture and apparatus. In particular, the present invention relates to touch therapy-facilitating furniture adapted to support both patient and therapist in a tandem configuration.

BACKGROUND

Tables and chairs, typified by U.S. Pat. Nos. 6,934,988 and 4,662,361, are known for the support of patients during delivery of physical therapy in the form of manual massage by a therapist. Those tables and chairs have the disadvantages of 1) fatigue and repetitive stress injury to the therapist's hands and limbs, and 2) fatigue to the torso of the therapist from leaning over the patient.

SUMMARY

The present invention avoids the disadvantages of the prior art by presenting the patient to a seated or recumbent therapist in such a manner that the therapist may use the stronger and more fatigue resistant muscles of the feet, legs, and thighs in delivering therapy to the patient. The structure disclosed also reduces back and abdominal fatigue to the therapist during manipulation by supporting the torso of the therapist.

OBJECTS

An object of the present invention is to reduce fatigue and repetitive stress injury to the hands, wrists, arms and upper body of the therapist.

An additional object of the present invention is to reduce fatigue to the back and torso of the therapist by supporting the therapist in a comfortable reclining position during the therapy.

An additional object of the present invention is that the duration of therapy may be longer and more effective before the therapist is fatigued.

An additional object of the present invention is that a therapist, even one with low upper body strength, may deliver therapy at a high energy level.

An additional object of the present invention is that a therapist may obtain exercise benefits by working large long muscles over a longer time period to burn a greater number of calories than would be possible by using the muscles of the upper body.

An additional object of the invention is to enable the patient to assist in directing his own therapy.

DRAWINGS

FIG. 1A is a side view of a configuration of the present invention having a second seat carriage supported by an adjustably inclinable longitudinal support rail, and a separately inclinable first seat.

FIG. 1B is a side view of a configuration of the present invention having an adjustably inclinable frame supporting both first and second seats.

FIG. 1C is a side view of a configuration of the present invention having a fixed track and inclinable front seat.

FIG. 7A is a cross section of an I-beam track and carriage having friction plate adjusting means.

FIGS. 7B, 7C, 7D, and 7E are side views of friction plate adjusting means.

FIG. 7F is an end view of a track and carriage having horizontally oriented friction plate adjusting means.

FIGS. 8A through 8E are cross-sectional end views of various track configurations.

FIGS. 9A through 9D are side views of viscoelastic damping means.

FIG. 11A is and end view of the first seat pictured in FIG. 1A.

FIG. 11B is and end view of the first seat pictured in FIG. 1B.

FIG. 11C is and end view of the first seat pictured in FIG. 1C.

Figure 12:
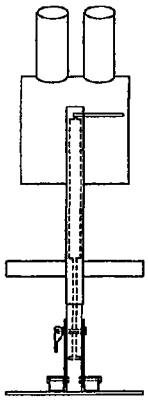
Figure 2:
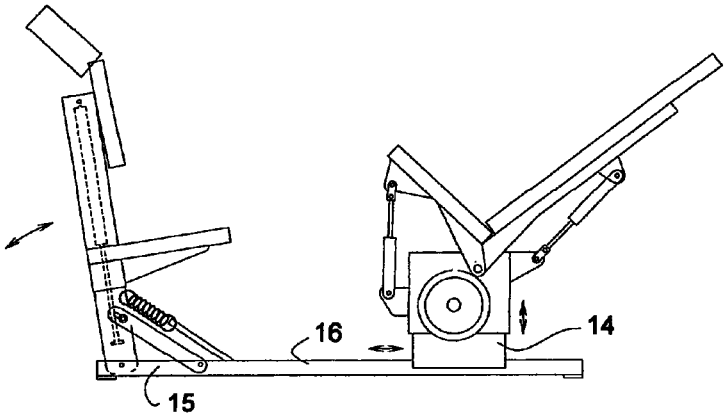
FIG. 2 is a side view of a configuration of the present invention having an elevating second seat on a horizontal or inclined track.

FIG. 12 is and end view of the first seat pictured in FIG. 2.

Figure 14:
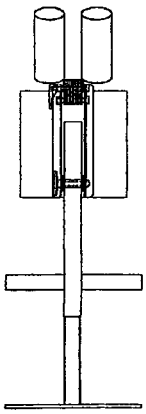
Figure 4:
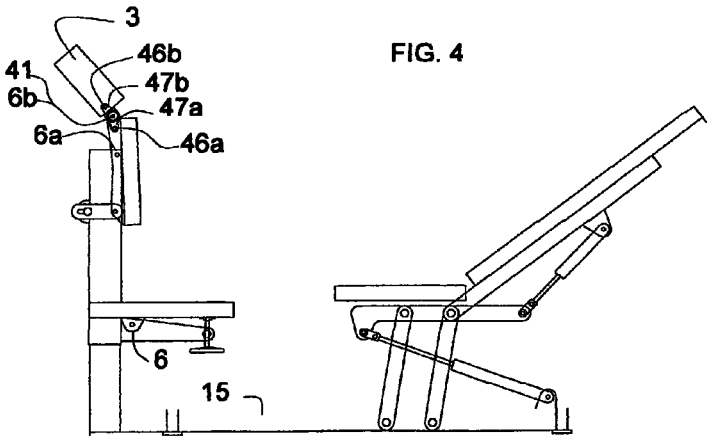
FIG. 4 is a schematic side view of a configuration of the present invention having dual pivoting arm supports for second seat means.

FIG. 14 is and end view of the first seat pictured in FIG. 4.

DESCRIPTION OF THE PRESENT INVENTION

The invention as disclosed in the drawings and the claims provides for the tandem seating of patient and therapist.

Figure 5B:
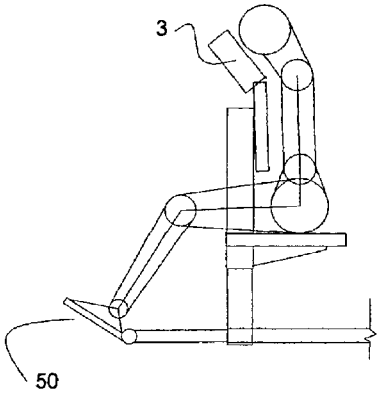
FIG. 5B is a schematic side view of footrests added to the embodiment of FIG. 5A or 6A.
Figure 5A:
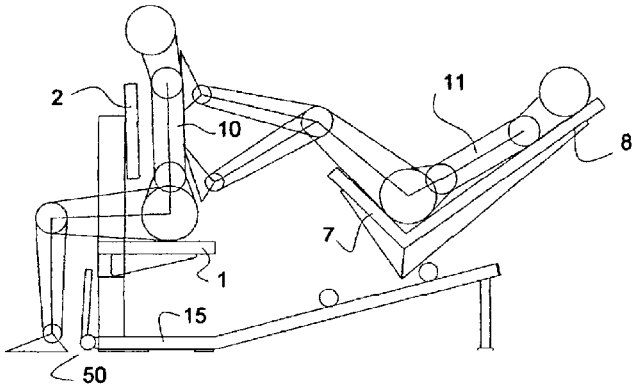
FIG. 5A is a schematic side view of a therapist applying foot pressure to a patient's torso using the device and method of the present invention.
Figure 6B:
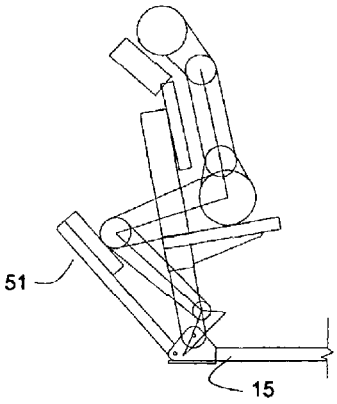
FIG. 6B is a schematic side view of knee-rests added to the embodiment of FIG. 5A or 6A.
Figure 6A:
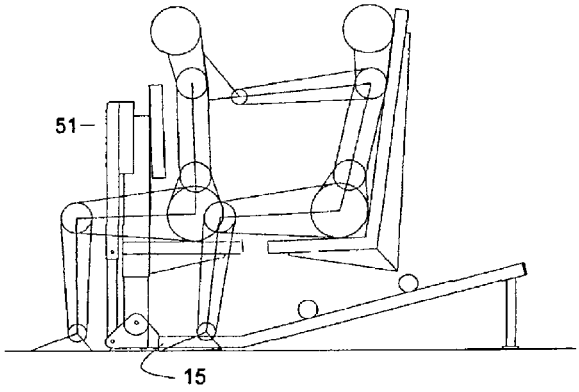
FIG. 6A is a schematic side view of a therapist applying hand pressure to patients torso using the device and method of the present invention.

In FIGS. 5A and 6A, patient 10 sits on first seat 1 supported by first lateral rest 2 which may include head rest means 3 in rigid fixed or adjustable proximity thereto.

In FIG. 11C, first seat 1 preferably includes vertical adjusting means, preferably aided by vertical gas cylinder 4, preferably having hydraulic release lever 5 extending from upper end of cylinder. First seat preferably includes means for angular adjustment about a pivot point 6 between seat 1 and cylinder 4 as in FIG. 1A or FIG. 4, or between cylinder 4*a* and support frame 15, as in FIG. 1C. Lateral rest 8 may include separate adjusting means about separate pivot point 6*a* as in FIG. 4, and headrest means 3 preferably includes separate adjusting means about headrest pivot 6*b*.

In FIGS. 5A and 6A, therapist 11 is supported by second seat 7 and second lateral rest 8, both of which may be adjusted laterally toward or away from patient by adjusting means 9, and which may be further adjusted by seat and lateral angular adjusting means 12 and 13, as in FIGS. 1A, 1B, and 1C.

In FIG. 1B common framework 15, in combination with said lateral supports and adjusting means hold the two occupants in fixed position. Substantially vertical sleeves 15*a* and 15*b* receive first and second vertical legs 14*a* and 14*b*, extending from horizontal foot means 14*c* and 14*d*. First leg 14*a* extends into first chair sleeve 14*e*. Vertical adjusting means 4, preferably in the form of a pneumatic cylinder inside first leg means 14*a*, allows vertical adjustment of first scat with minimal leg effort by patient.

Second seat is preferably supported by carriage means 21, preferably constrained by wheel means 22 on track means 16 extending longitudially along an axis substantially parallel to an axis extending between first and second seats.

Second seat and lateral rest means may also optionally be adjustable vertically by second vertical adjusting means 14*b*, which may lift just the second seat as in FIG. 4, or lift an end of support rail 16 as in FIG. 1A, or lift the entire end of common framework 15 supporting both first and second seat, as in FIG. 1B, thereby adjusting the angle of front seat and track simultaneously.

Lateral or angular or vertical adjusting means may be by any suitable mechanism, including hydraulic cylinders, stacked plate spring clamps, jack screws, or simple slides and locking screws, preferably assisted by force means such as springs or gas cylinders.

Force means 17, for instance gravity, spring, or gas cylinder or combination thereof, urges second seat means 7 preferably toward first seat means, opposed by positioning leg effort by therapist. Preferably damping means 18 attached to second seat, for instance a hydraulic cylinder, prevents rapid motion of said second seat when unrestrained by user or locking means.

Figure 9A:
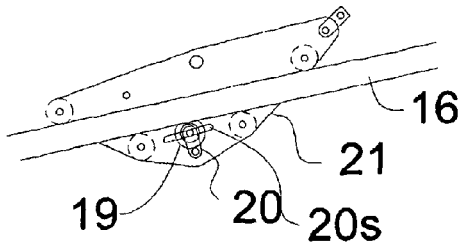

A preferred embodiment of damping means 18 in FIG. 9A comprises a viscoelastic wheel means 19, the axis of which travels in slot or track 20*s*, oblique to carriage means 21 holding second seat means 7, and riding on track means 16, tightening or loosening said wheel against said track means 16 depending on the direction of travel of said carriage means.

Alternatively said wheel axis may pivot on eccentric lever means 20. Lever arm of said eccentric is sharply obique to the track surface, pivoting in such a manner that motion of carriage means 21 in the direction of force means 17 causes lever 20 to rotate to tighten said viscoelastic wheel against track, creating a damping force resisting linear motion, while motion in opposite direction rotates lever to loosen said wheel. Spring or other means is used to urge wheel against track when not forcefully engaged by eccentric.

Figure 9B:
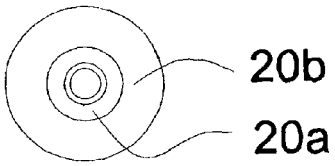

Said viscoelastic wheel may have rigid core means 20*a* and viscoelastic outer tire 20*b*, as in FIG. 9B.

Figure 9C:
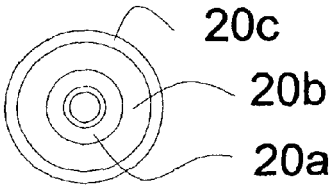

Alternatively said viscoelastic wheel may preferably have rigid core means 20*a* and rigid outer tire 20*c* with viscoelastic material 20*b* in the anulus therebetween, as in FIG. 9C.

Figure 9D:
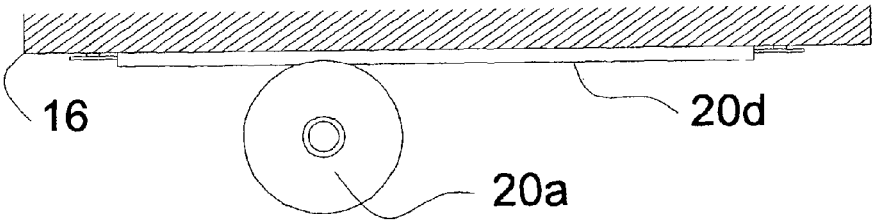

Alternatively said tire may be of rigid material riding on a viscoelastic track surface, preferably in the form of an elastomer-coated preferably flat bar or cable 20*d* pulled taught by its ends along the path of said wheel, if FIG. 9D.

In FIGS. 7A and 7B said carriage means preferably comprises opposing members 21A and 211B, stradling I-beam rail means 16. Opposed clamping means (for instance solid bars) 30*a* and 30*b* pulled together by tie rod means 31A and 31B, preferably above and below track 16, in combination with spring means 37 apply pressure to opposing piston means 34, which in turn apply pressure normal to surfaces of interleaving fixed longitudinal friction plates 32 and movable friction plates 33 attached flexibly to carriage 21 by anchor means 35.

Release handle 39, preferably coaxial with spring means 37 on tie rod 31A rigidly connects to preferably domed lever means 38 which functionally engages shoulder means 31C and clamp means 30 to force clamps 30*a* and 30*b* apart with mechanical advantage when force is applied to handle 39 in preferably any direction, thereby relieving pressure on friction plates 32 and 33.

FIGS. 7C and 7D shows typical friction means used for angular adjustment of first or second seat or lateral supports or headrest means. Preferably slotted friction plates 42 having slot 45 and one or more anchor means 46 in a stack penetrated by tie rod 41 are pressed in friction engagement with interleaving friction plates 43 in the form of washers in FIGS. 7C and 7D or plates pivoting plates 47 in FIG. 7E.

Figure 8A:
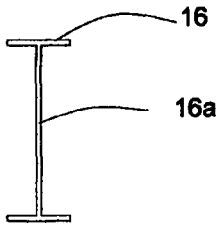
Figure 8B:
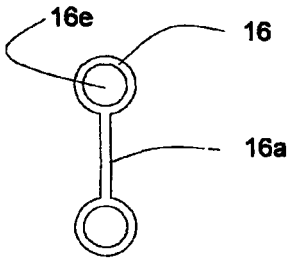
Figure 8C:
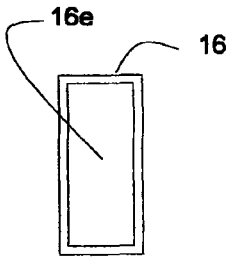
Figure 8D:
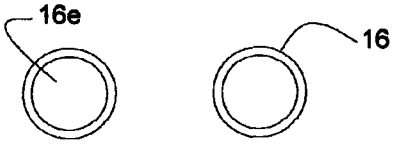
Figure 8E:
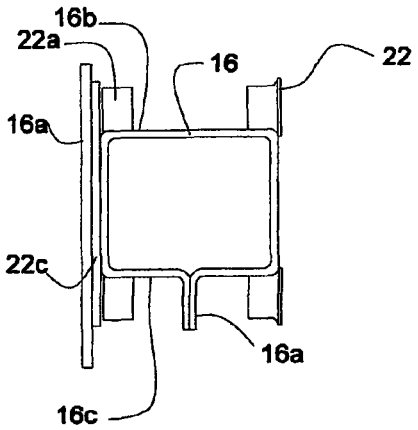

Track means 16 is preferably a monorail, and may be for example a box as in FIG. 8C or an I shape as in FIG. 8A or 8B. Alternatively, track means may comprise multiple rails, for instance twin horizontal rails shown in FIG. 8D, or preferably an extruded or formed cross section of any appropriate shape as in FIG. 8E. Web means 16*b* extending from bottom of rail 16, in FIG. 8E may serve as a support for a stack of longitudinal friction plates, which may be penetrated by a tie rod slot, or it may utilize c-clamp means or dual tie rod means for clamping as in FIG. 8Aa.

Track means 16 preferably includes support surfaces 16*b* and 16*c* by which guides or wheels mounted to carriage means support said carriage in fixed orientation to said track means. Wheels may have lateral support means, such as flanged wheels 22*b*. The preferred embodiment employs simple low-friction polymer skid plate means 22*c*, constrained from planar displacement by loose engagement with axles, tie rods, or standoffs, and attached preferably to said carriage means, and engaging carriage and track means in lateral alignment of carriage to said track means. Carriage may then preferably use simple bearing means or cylindrical wheel means 22*a* as shown for vertical support and alignment.

A preferred track and carriage combination in FIG. 7F includes track means 16 having a substantial horizontal surface 16*b* engaging linear bearing means 22*d*, preferably in the form of a continuous ball race, which provides vertical support for said carriage means 21.

A preferred track configuration has a concavity in lower surface concealing adjusting means and/or damping means. Adjustment locking means may be, for example, a valved cylinder as shown in previous figures, or as shown in FIG. 7F, a stacked plate set having a single tie rod 31 through slot in fixed plates 32*s* and hole in moving plate 33*s* functionally attached to said carriage. Track means preferably has tubular component or components 16*e* to resist torsion.

An alternative adjusting mechanism for the headrest includes two stacks of interleaving plates 47*a* and 47*b* compressed by tie rod 41 at headrest pivot axis 6*b*, and rotationally fixed to support and headrest means by anchor means 46*a* and 46*b*.

Anchor means 35, 36, and 46 may be any means resisting linear displacement of a plate parallel to its surface, but are preferably cylindrical means such as a pin or shoulder bolt, through a loosely fitting hole in said plate.

An advantage of clamp bars 30 is that it avoids weakening track 16 with a slot, and it multiplies the force of spring means 37 through mechanical advantage to the friction plates, as compared to slotted plates penetrated by a single sprung tie rod.

An alternative embodiment may include fixed, adjustable, or retractable footrest means 50 or knee rest means 51, as in FIGS. 5B and 6B for either occupant.

Seats and lateral rests preferably include padded upholstery.

Figure 3:
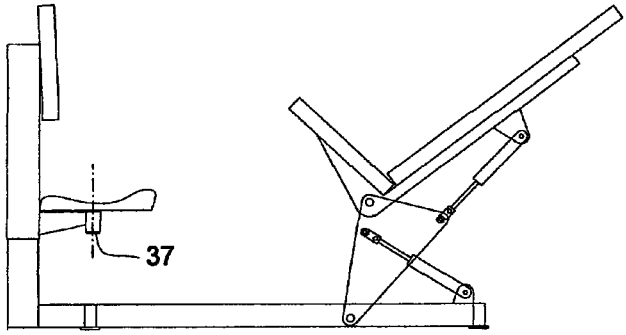
FIG. 3 is a schematic side view of a configuration of the present invention having a pivoting support for the second seat means

In FIG. 3, either of first or second seats may be contoured to enhance comfort, and swivel means 40 about a vertical axis may be provided for one or both seats to enhance comfort when the seating position of one or both occupants is reversed.

The therapist applies hand or foot pressure, or a combination thereof, to the patient. In applying foot pressure to massage a back, the therapist avoids fatigue and repetitive stress injury to hands, wrists, and arms by utilizing the larger and more durable muscles and joints of the legs and feet. Further, the back support provided to the therapist during manipulation is not found in other massage chairs, and reduces spinal and abdominal exertion and fatigue.

Vertical adjustment means 4 and 5 enable patient in first seat to adjust his own vertical position during therapy, thereby directing and assisting in his own therapy.

Carriage may travel freely along track during therapy or remain in fixed adjusted position relative to first occupant. Device may include separate therapeutic pressure limiting means, for example a relief valve on a cylinder controlling horizontal motion.

The description and illustrations enclosed herein are merely schematic examples of the claimed invention. Obvious modifications which might facilitate use for intimate contact are included within the scope of the present invention. Deviations from the configurations described herein which may be obvious to those skilled in the art, fall within the scope of this invention, as does the described method of providing massage therapy from a tandem seated position using furniture providing adequate support.

I claim the following:

1. A therapeutic support apparatus comprising:

first and second chairs adapted to support first and second occupants respectively, said first and second chairs defining first and second ends of a main axis, each said chair comprising at least one support surface, each said chair adapted to apply vertical and horizontal support to an occupant, each said chair comprising a torso rest component comprising a surface adapted to engage the torso of its occupant, at least said first said chair comprising a seat component configured at a fixed or variable angle relative to the torso rest of said first chair, each said chair configured to position the torso of an occupant engaged by its torso rest substantially between said torso rests;

said apparatus comprising a frame connecting said chairs;

a combination of said frame and said first chair adapted to provide open area of sufficient size and shape to enable the substantially forward extension of thighs by an occupant positioned between said torso rests with chest against the torso rest of said first chair;

said combination of said frame and said first and second chairs adapted to resist the force and moment resulting from substantially horizontal therapeutic massage pressure by one occupant on the body of the other with a degree of resistance sufficient to maintain a substantially fixed distance between the two occupants while one occupant exerts a force sufficient for providing therapeutic massage to the other occupant;

said apparatus further comprising a carriage associated with at least one of said chairs, and said apparatus comprising a track associated with or integral with said frame component, said carriage adapted to travel in a direction defined by said track, in sliding or rolling engagement with said track, such that movement of said carriage along said track substantially alters a vertical position of said at least one said chair or of said at least one said chair.

2. The apparatus according to claim 1, wherein:

said frame is adapted to engage a floor, said track having first and second ends, said first end located at a substantially fixed position relative to said floor, said second end higher than said first end, said track defining a carriage path, said path having a predominant vertical vector component.

3. The apparatus according to claim 1, comprising:

a second track having a path substantially in a vertical plane, said vertical plane substantially parallel to said main axis, a carriage associated with said second chair, the carriage associated with said second chair adapted to slide or roll on said second track, and said second track fixedly or adjustably inclined from horizontal.

4. The apparatus according to claim 1, said frame comprising:

a substantially non-vertical frame component, a substantially vertical sleeve secured relative to one end of said substantially non-vertical frame component, and further comprising in sliding fit with said sleeve a substantially vertical leg extending from said sleeve, such that height and angle of said substantially non-vertical frame component may be set by the position of said leg in said sleeve.

5. The apparatus according to claim 1, said frame comprising a sleeve and a leg, said sleeve configured to substantially surround a portion of the length of said leg, said leg defining a said track, said leg adapted to be slidingly or rollingly engaged by a said carriage, said leg-engaging carriage adapted to be fixedly or pivotingly engaged with at least one component of a said chair.

6. The apparatus according to claim 1, wherein:

said carriage is associated with at least one mechanical, or pneumatic spring, said spring adapted to move or assist moving said chair to a position of lower spring energy when said chair is not locked to said frame and when occupant force against said chair enables said motion.

7. The apparatus according to claim 1, comprising:

at least one damper adapted to oppose travel of said carriage along said track, where said damper comprises at least one wheel urged toward said track during travel of said carriage in at least one direction along said track, where one or more of said wheel and track comprise an elastomeric component compressed or otherwise deformed by urging together of said track and said wheel, and where travel of said wheel along said track advances deformation of said elastomeric component such that the energy required to advance deformation of said elastomeric component results in a force opposing travel of said carriage.

8. The apparatus according to claim 1, comprising at least one lock configured to enable fixing the position of a said carriage relative to said frame.

9. An apparatus comprising support for first and second occupants, said support defining first and second chairs, respectively, said chairs configured to position said first occupant in front of said second occupant, said apparatus further comprising one or more frame components configured to connect said chairs to each other, each said chair configured to apply a combination of vertical and horizontal support to its occupant, said frame and chair combination adapted to resist the force and moment created by repulsive hand or foot pressure by one occupant upon the body of other, said first and second chairs defining first and second ends of a main axis said apparatus comprising at least one adjuster, said first and second chairs comprising surfaces defining first and second lateral rests respectively, at least said first chair comprising a support surface defining a seat, at least one said adjuster configured to enable a user to alter the horizontal distance of a component of one said chair from a component of said other chair, at least one said adjuster configured to enable a user to alter the degree of resistance to horizontal displacement between said first and second components, at least one said adjuster configured to enable a user to alter the vertical distance of a component of said first chair from a component of said second chair, at least one adjuster configured to enable a user to alter the degree of resistance to changes in said vertical distance in at least one direction.

10. The apparatus according to claim 9, said apparatus comprising or configured to receive, in association with each of said first and second chairs, headrest means.

11. The apparatus according to claim 9, said apparatus comprising at least one headrest, at least one said headrest configured with a nose receiving void.

12. Therapeutic apparatus comprising support for first and second human occupants in a tandem configuration, each facing the same compass direction, said support comprising first and second substantially opposing torso rests, said torso rests comprising surfaces adapted to engage a substantial width of the torsos of said first and second occupants respectively, said support further comprising at least a first seat, each said seat comprising support surface(s) adapted to engage the buttocks and/or thighs of a seated occupant, said first seat adapted to so engage said first occupant, said torso rest surfaces and said seat support surface(s) of said apparatus configured to position the torso of each occupant substantially between said torso rests, said apparatus adapted to provide open area of sufficient size and shape to enable forward extension of thighs by said first occupant when the chest of said first occupant is engaged by said first torso rest, said apparatus comprising at least one adjuster, at least one said adjuster adapted to enable a user to displace at least one torso rest from a first position to a displaced position relative to the opposing torso rest, said displaced position selected by said user from at least two positions within the relative range of motion of said torso rests, said displacement substantially altering the distance between said torso rests, said apparatus adapted to resist relative displacement of said torso rests in at least one direction, at least one said adjuster adapted to enable a user to alter the degree of said resistance to displacement in at least one direction from said displaced position, at least one said adjuster adapted to enable altering the elevation of a said support surface for at least one occupant relative to a said support surface for the other.

13. A method of delivering massage therapy comprising supporting a patient and a seated or recumbent therapist between the torso rests of the apparatus according to claim 12, said therapist applying repulsive pressure to the patient at least by foot, where substantially centrifugal force resulting from said repulsive pressure is opposed by the force of said apparatus on both patient and therapist.

14. The apparatus according to claim 12, said apparatus comprising at least two said adjusters, a handwheel associated with at least one said adjuster, a carriage adapted to travel on a substantially horizontal track, said carriage and a chair associated with said at least one adjuster such that rotation of a said handwheel alters the elevation of said chair relative to said carriage.

15. The apparatus according to claim 12, comprising a frame said support for first and second occupants defining first and second chairs, respectively, said frame and chair combination adapted to resist the force and moment resulting from substantially horizontal therapeutic massage pressure by one occupant on the body of the other, said adjuster or adjusters comprising at least one lock enabling the position of at least one chair component to be substantially fixed against motion in at least one direction relative to the position of another component of said apparatus, each said lock engageable and disengageable by a user, such that when all said locks are engaged, rigidity of said apparatus in resistance to said force and moment is increased.

16. The apparatus according to claim 15, and further comprising at least one face rest, said face rest comprising at least one surface adapted to support the face of an occupant in opposition to the forces of gravity and therapeutic massage, said at least one surface having a nose-receiving void.

17. The apparatus according to claim 15, said first and second chairs defining first and second ends of a main axis, said apparatus adapted to resist displacement of at least one said torso rest in a vertical plane substantially parallel to said main axis, the degree of said resistance to said displacement in one direction defining a resistive limit, force of therapeutic massage substantially limited by movement of said at least one torso rest in response to applied force exceeding said resistive limit.

18. The apparatus according to claim 15 said adjuster or adjusters comprising means to adjust the vertical position of at least one said chair or chair component, means to adjust the horizontal position of at least one said chair or chair component, means to adjust the angle of at least one said chair or chair component relative to another component of said apparatus about a horizontal axis, said adjustment means comprising means to alter the degree of resistance of said apparatus to displacement of said chair or chair component from an adjusted position selected by a user, said means enabling chair positions suitable for application of therapeutic massage pressure by one occupant to the torso of the other alternately by hand and by foot.

19. Apparatus according to claim 15, comprising at least one link supporting at least one of said first and second chairs relative to said frame, said link connected to said frame and to said chair, or to a carriage associated with said chair, where the connection of said link at least to said frame comprises a pivot, said first and second chairs defining first and second ends of a main axis, enabling said link to rotate substantially in a vertical plane parallel to said main axis, where said rotation of said link enables movement or adjustment of said chair in a substantially arcuate path, about said pivot.

20. The apparatus according to claim 15, comprising at least one damper, said damper adapted to oppose the motion of a chair or chair component in at least one direction.

21. The apparatus according to claim 15, each said chair comprising a seat component suitably located to enable support of an occupant positioned substantially between the torso rests, each said chair adapted to enable positioning at least the torso of a human occupant within a range of postures between substantially seated and substantially recumbent, said torso rests adapted to apply force to said occupants in opposition to the centrifugal force resulting from said repulsive pressure.

22. The apparatus according to claim 12 at least one said adjuster adapted to enable predominantly vertical displacement of a said support surface for at least one occupant relative to a said support surface for the other, and at least one said adjuster adapted to enable predominantly horizontal displacement of a said support surface for at least one occupant relative to a said support surface for the other, and said adjusters adapted to enable user-changeable resistance to displacement from said adjusted relative position.

23. The apparatus according to claim 22, where the degree of relative movement and adjustment enabled by said adjuster or adjusters is sufficient to enable the relative positioning of the occupants at distances and angles suitable for application of foot pressure by one occupant to substantially the length of the torso of the other.

24. The apparatus according to claim 12, said apparatus comprising at least one carriage associated with at least one said support surface, at least one track adapted to engage a said carriage by wheel or slide means, said track and carriage configured such that travel of said carriage along said track alters the elevation of said carriage, surfaces associated with said track and carriage configured to enable sufficient tangential resistance to substantially prevent rotation of said carriage about said track.

25. The apparatus according to claim 24, at least one said track having a non-circular cross section, a carriage associated with a said track comprising a sleeve configured for sliding fit with said track.

26. The apparatus according to claim 24, at least one said carriage associated with a seat, travel of said at least one carriage on a said track enabling substantial change in elevation of said associated seat, said track or carriage configured to extend from a location below a plane defined by said associated seat to a location above said plane when said carriage is located at the lower end of its travel.

27. The apparatus according to claim 12, said apparatus comprising connection among torso rests and said seat(s) support surfaces, said connection adapted to enable substantial prevention of rotation of at least one said torso rest about a vertical axis relative to the other torso rest.

28. The apparatus according to claim 12 said adjuster or adjusters comprising at least one angular adjuster, at least one said angular adjuster adapted to enable displacement of a torso rest and/or seat about a horizontal axis to a destination angle selected by a user, at least one said angular adjuster adapted to enable a user to alter the degree of resistance to angular displacement in at least one direction from said destination angle.

29. The apparatus according to claim 12, said first and second torso rests defining a main axis, where the total width of obstruction to said forward extension is configured to be less than half the witdth of said first torso rest, said widths measured in a horizontal direction normal to said main axis.

30. The apparatus according to claim 12, wherein: at least one said adjuster is adapted to enable altering the resistance of said apparatus to change in said elevation in at least one direction.

* * * * *